US005921258A

United States Patent [19]

Francois

[11] Patent Number: 5,921,258

[45] Date of Patent: Jul. 13, 1999

[54] ADJUSTABLE REMOVABLE WEATHER SHIELD FOR A WHEELCHAIR

[76] Inventor: Wade Francois, 2436-15th Ave., San Francisco, Calif. 94116

[21] Appl. No.: 08/976,561

[22] Filed: Nov. 24, 1997

[51] Int. Cl.[6] ..... E04H 15/06; A61G 5/10; A47C 7/66

[52] U.S. Cl. ..... 135/88.03; 135/88.01; 135/96; 135/143; 135/117; 297/184.11; 297/184.17; 297/DIG. 4; 280/304.1

[58] Field of Search ..... 135/88.01, 88.02, 135/88.04, 96, 117, 143, 88.03; 297/184.1, 184.11, 184.15, 814.17, DIG. 4; 280/304.1

[56] References Cited

U.S. PATENT DOCUMENTS

| | | | |
|---|---|---|---|
| 574,235 | 12/1896 | Bennitt | 135/88.04 |
| 4,389,057 | 6/1983 | Richard . | |
| 4,643,479 | 2/1987 | Servi . | |
| 4,949,740 | 8/1990 | Friday | 135/117 X |
| 5,168,889 | 12/1992 | Diestel | 138/88.01 |
| 5,299,337 | 4/1994 | Venza . | |
| 5,301,975 | 4/1994 | Rivera | 135/88.01 X |
| 5,511,259 | 4/1996 | Tarara | 135/147 X |
| 5,695,100 | 12/1997 | O'Brien | 135/143 X |

*Primary Examiner*—Robert Canfield

*Attorney, Agent, or Firm*—Michael A. Kaufman; Flehr Hohbach Test Albritton & Herbert LLP

[57] ABSTRACT

A detachable and collapsible weather shield for a wheelchair may be user-disposed in a user-selected orientation. The weather shield includes first and second generally inverted "U"-shaped frames, in which the distal leg ends of the second frame are pivotally joined by a coupler to a leg portion of the legs of the first frame. A flexible moisture resistant canopy extends over at least the top portion of the frames and preferably also extends downward to also cover a portion of the legs. A releasable pivotable anchor is secured to one and preferably both wheelchair push arm regions, and permits releasably and rotatably attaching the distal leg ends of the first frame to the wheelchair. The anchor permits user-adjustment of the relative angular orientation of the first frame (and thus of the weather shield) and/or the vertical height (including complete removal) of the weather shield relative to the ground. The anchor unit may be manually operable, or may be motorized. If motorized, user-generated control signals may be wirelessly transmitted to a receiver associated with the motor, or hardwiring may be provided.

20 Claims, 6 Drawing Sheets

ADJUSTABLE REMOVABLE WEATHER SHIELD FOR A WHEELCHAIR

FIELD OF THE INVENTION

The present invention relates generally to wheelchairs and apparatus to shield a wheelchair user from rain and sun, and more particularly to such apparatuses as are user adjustable and removable.

BACKGROUND OF THE INVENTION

Wheelchair users are often exposed to inclement weather including rain, fog, wind, and/or excessively sunny weather while occupying a wheelchair. If the wheelchair is manually propelled, the user's hands are occupied and are not free to hold an umbrella or the like to protect the user in inclement weather. Even if the wheelchair is motorized, the user is often occupied in maneuvering the wheelchair. Also, some wheelchair users simply lack arm strength to hold an umbrella or the like in inclement weather.

Several attempts have been made in the prior art to try to protect wheelchair users from inclement weather. For example, U.S. Pat. No. 4,389,057 to Spence, Jr. (1983) discloses a transparent wheelchair cover comprising a number of clear panels removably attached to the front of the wheelchair. The cover is supported by a frame having a pair of substantially vertical members joined at the top by a horizontal member. When deployed, Spence's cover appears to have been locked in a static position, as though incoming rain or sunshine always fell perpendicularly to the ground. U.S. Pat. No. 4,949,740 to Friday (1990) discloses a transparent rain hood apparatus for wheelchair users. Friday provides a symmetrical collapsible tubular structure removably attached to the wheelchair undercarriage, and topped by a plastic covering. The support frame includes a rectangular shaped portion of four tubular members hingedly joined at two front and two rear corners. Like Spence's device, the device disclosed by Friday appears to assume that rain and sunshine will fall perpendicularly to the ground.

U.S. Pat. No. 4,643,479 to Servi (1987) discloses a wheelchair canopy shade having a frame mountable to the handle grips of the wheelchair. The frame includes at least two vertically disposed posts that are braced by at least one transverse member. Roof-forming members are connected to the top ends of the two vertically disposed posts, and a vinyl or canvas parasol shade snaps on to the frame. However, Servi's vertical members appear to be static vertical, although the roof portion seems pivotable rearward toward the vertical posts.

U.S. Pat. No. 5,168,889 to Diestel (1992) discloses a wheelchair removable weather breaker cover that is removably secured by a cover support clamp bracket. A tubular extension may be fitted to the clamping bracket to promote stability of Diestel's wheelchair cover. The cover is attached by two short tubular members that releaseably clamp to vertical posts that are positioned adjacent the wheelchair handles. Not unlike several of the prior art designed described above, Diestel's structure is essentially disposed statically horizontally and vertically. Unfortunately, such static structure does not permit varying the cover orientation should rain or sunshine fall other than perpendicularly to the ground.

Thus, there is a need for an adjustable wheelchair shield that can be oriented in other than a purely horizontal-vertical configuration. Such shield should be user adjustable with respect to orientation, and preferably should be collapsible so as to not require removal from the wheelchair when not in use. Such shield should, however, be readily removable. Further, such shield should be mechanically reconfigurable for use by wheelchair users who lack sufficient arm strength to manually adjust the shield. Finally, to promote wide spread use of such a shield, the shield should be readily and economically manufacturable.

The present invention provides such a wheelchair shield.

SUMMARY OF THE INVENTION

The present invention provides a detachable and collapsible weather shield for a wheelchair that may be user-disposed in a user-selected orientation. The weather shield includes first and second generally inverted "U"-shaped frames, in which the distal leg ends of the second frame are pivotally joined by a coupler to a leg portion of the legs of the first frame. A flexible moisture resistant canopy extends over at least the top portion of the frames and preferably also extends downward to also cover a portion of the legs. The spaced-apart width of the frames is substantially the spaced-apart distance between the push arm portions of the wheel chair.

A releasable pivotable anchor is secured to one and preferably both wheelchair push arm regions, and permits attaching the distal leg ends of the first frame to the wheelchair. The anchor permits user-adjustment of the relative angular orientation of the first frame (and thus of the weather shield) and/or the vertical height of the weather shield relative to the ground. The anchor unit may be manually operable, or may be motorized. If motorized, user-generated control signals may be wirelessly transmitted to a receiver associated with the motor, or hardwiring may be provided.

User-adjustment of the anchor permits orienting the canopy to a desired height and angle to shield against rain, wind, sun, and the like. The user may also collapse the second frame into the first frame, thus folding the canopy, and then rotate the first frame rearward 180° to store the weather shield in a vertical downward orientation, just behind the wheelchair seat. Of course, the user may simply remove the first frame from the anchor(s) to remove the weather shield from the wheelchair.

Other features and advantages of the invention will appear from the following description in which the preferred embodiments have been set forth in detail, in conjunction with the accompanying drawings.

DESCRIPTION OF THE PREFERRED EMBODIMENTS

Figure 1A:
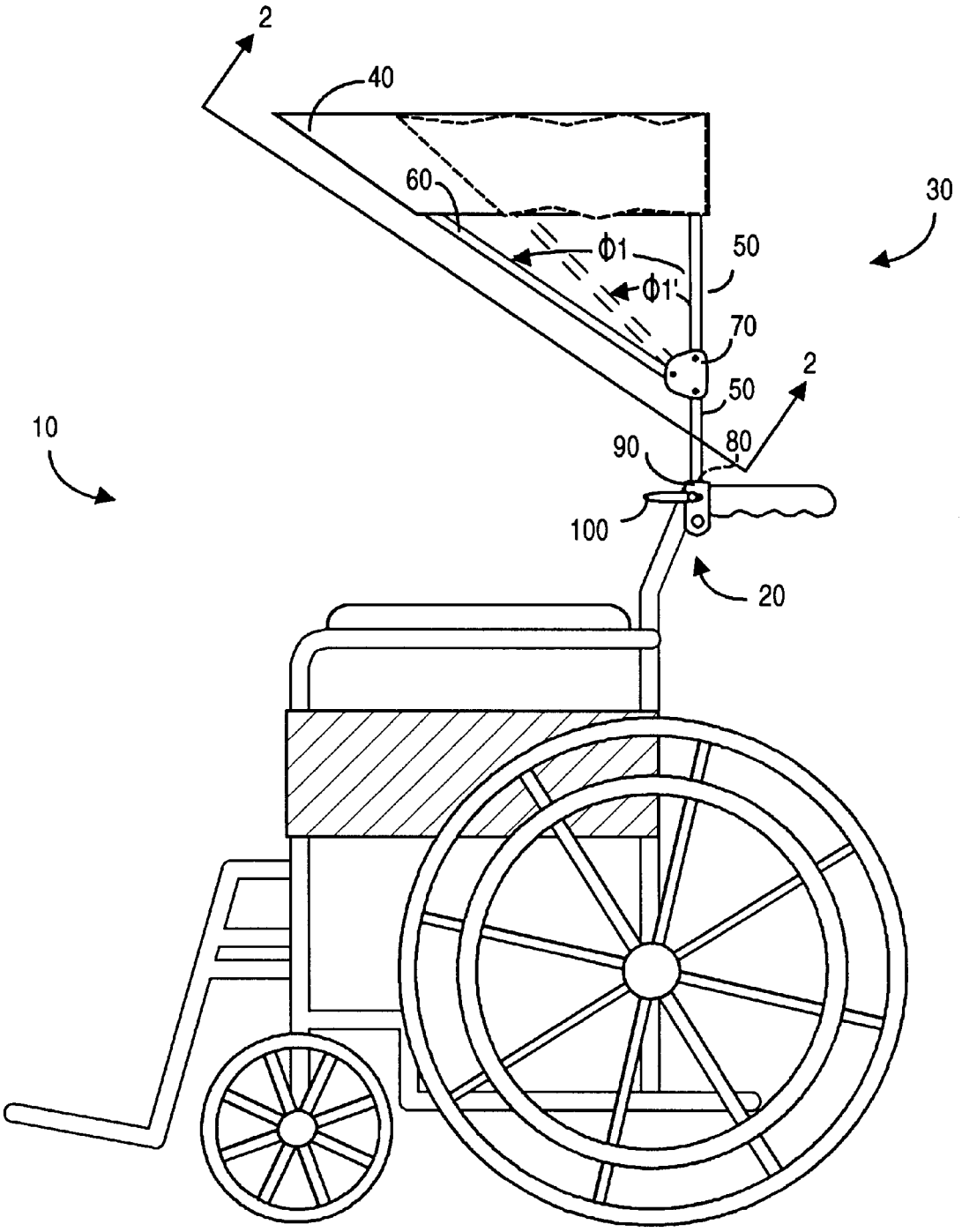
FIG. 1A is a side view of a wheel chair equipped with a manually detachable adjustable weather shield showing partial folding of the canopy, according to the present invention.

FIG. 1A depicts a generic wheelchair 10 whose left and right handle push arm portions 20 provide removable attachment for an detachable adjustable weather shield 30, according to a first embodiment of the present invention. Weather shield 30 includes a flexible and preferably water resistant canopy or tarpaulin 40 that is supported by first and second inverted "U"-shaped frame members 50 and 60 (see also FIGS. 2A and 2B). Canopy 40 may be a plastic material and preferably removably attaches to the framework provided by frame members 50 and 60 with snaps or the like (not illustrated). Members 50 and 60 preferably are a lightweight material such as metal, e.g., aluminum, plastic, fiberglass, epoxy, among other materials.

As shown, the distal end of the two legs of second frame member 60 are rotatably secured to a portion of two legs of first frame member 50 by a coupling unit 70. The lower portion of first frame member 50 exits coupling unit 70, continuing downward. The distal ends 80 of first frame member 50 are releasably clamped by an anchor unit 90 that preferably is mounted to the push arm portions 20 of the wheelchair. Preferably one anchor unit 90 is located near the right push arm portion of the wheelchair, and another anchor unit is located near the left push arm portion. While two anchor units 90 are preferred for stability and strength, it is possible to implement the present invention with a single adjustable anchor unit 90. In such a configuration, a passive member would loosely capture the distal end 80 of frame member 50 on the other push arm side of the wheelchair.

Figure 3A:
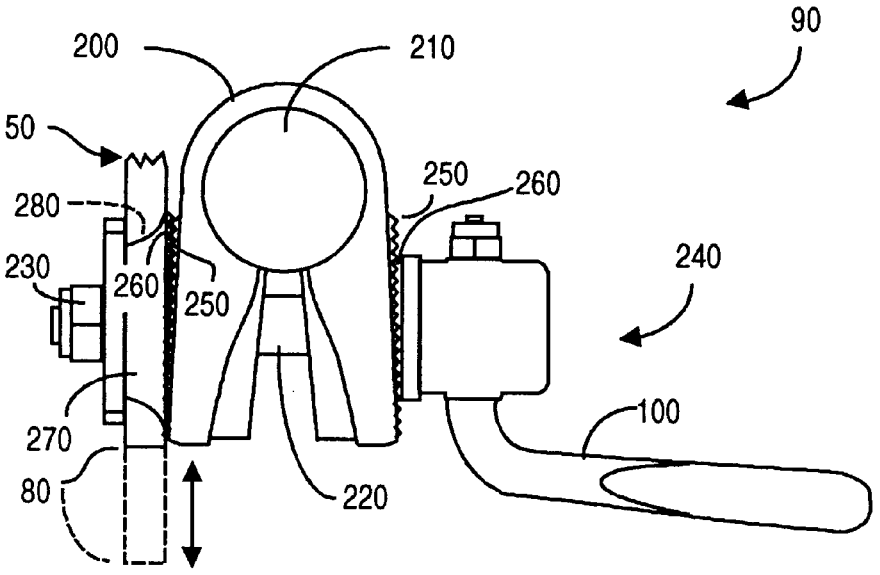
FIG. 3A is an end view of a manually adjustable anchor unit, according to the present invention.
Figure 3B:
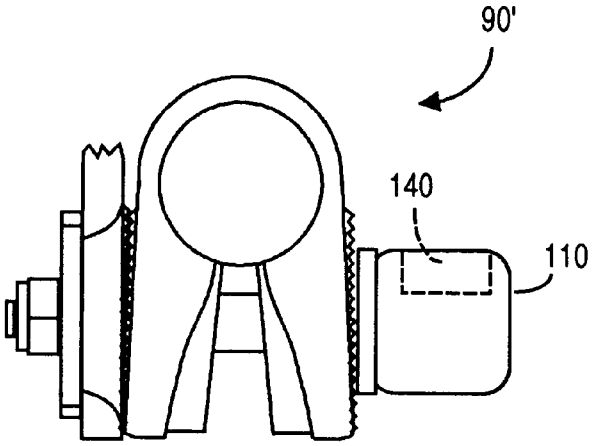
FIG. 3B is an end view of a motorized adjustable anchor unit, according to the present invention.

An exemplary anchor unit 90 is described later herein with respect to FIGS. 3A and 3B. In the embodiment of FIGS. 1A and 3A, anchor unit 90 is manually adjusted, for example with a lever 100. Operation of lever 100 is somewhat analogous to operation of a lever on a quick-release type mechanism such as may be found on a mountain bicycle. By contrast the embodiment of FIGS. 1B and 3B depict an anchor unit 90 that is adjusted with a motor.

As noted, members 50 and 60 are rotatably coupled via coupler 70. Thus, FIG. 1A depicts member 50 angled completely forward through an angle $\Phi 1$ of perhaps 60°, and in phantom lines member 50 is shown at a lesser angle $\Phi 1'$. Note that as angle $\Phi 1$ decreases toward 0°, flexible canopy 40 essentially folds up. Unit 70 may be implemented with rotation detentes that permit angular orientation every 10° for example, or may provide a frictional control permitting essentially continuous change in angle $\Phi 1$.

In addition to permitting the extent of canopy 40 to be controlled by rotating member 60 relative to member 50, the user can also rotate the entire weather shield 30. Thus, in FIG. 1B, the angle $\theta 1$ defined between the horizon and the vertical orientation of the weather shield is shown as being varied from $\theta 1$ to $\theta 1'$. Such adjustment is made by the user loosening anchor 90 such that first frame member 50 can be rotated through various angles $\theta 1$. Of course, the user may simultaneously vary angle $\Phi 1$ and angle $\theta 1$. Indeed, as shown by FIGS. 1C and 1D, angle $\Phi 1$ may be user adjusted to essentially 0° and angle $\theta 1$ may be user adjusted to essentially −90°. Further, FIG. 1C depicts a change in vertical adjustment (shown in phantom lines) of the weather shield, relative to the push arm regions of the wheelchair. If desired, the weather shield could be removed from the anchor unit, as described with respect to FIG. 3A, later herein. The −90° configuration shown in FIG. 1D represents stowing the weather shield while leaving it attached to the wheelchair.

Figure 1B:
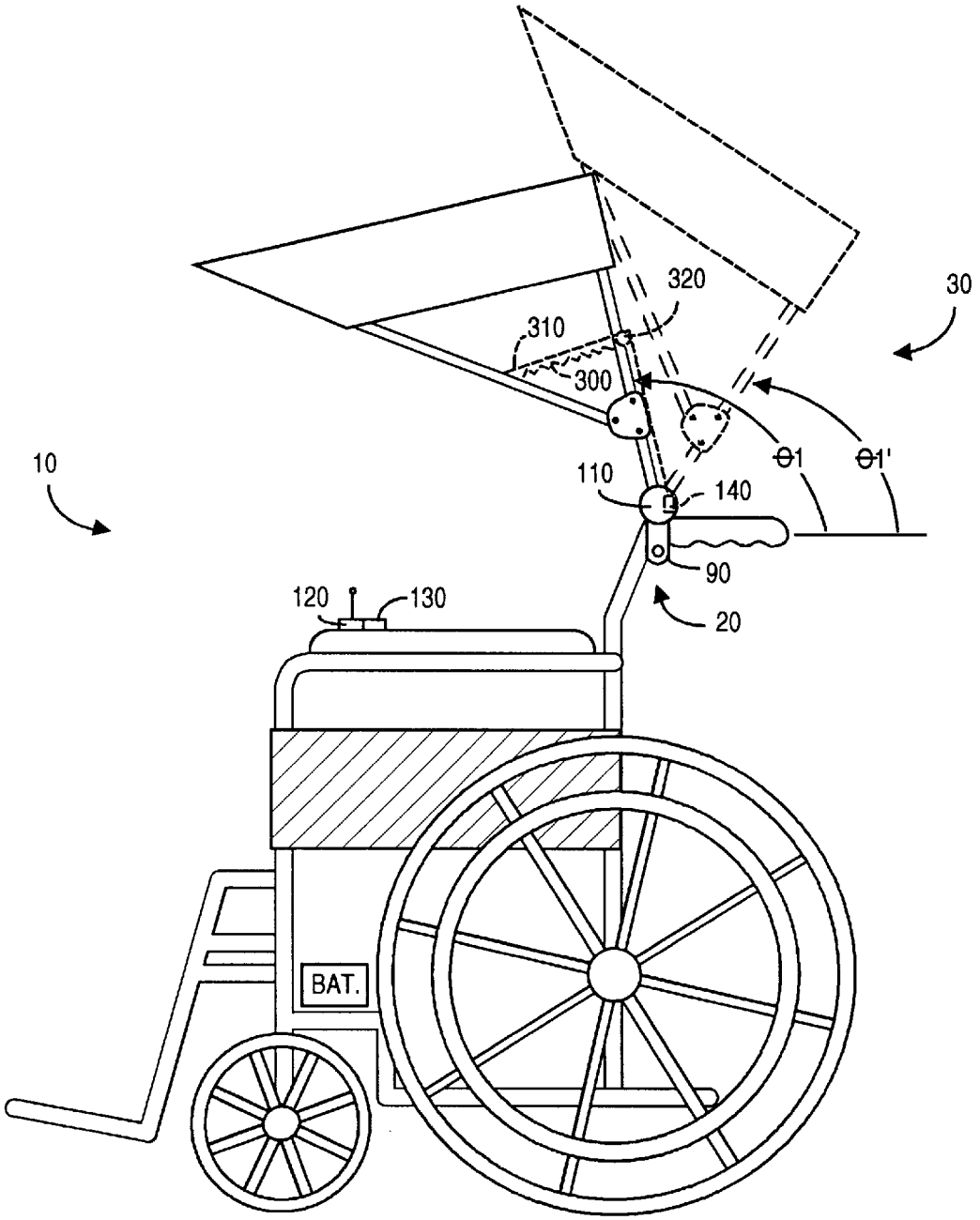
FIG. 1B is a side view of a wheel chair equipped with a motorized detachable adjustable weather shield showing angular repositioning, according to the present invention.
Figure 1C:
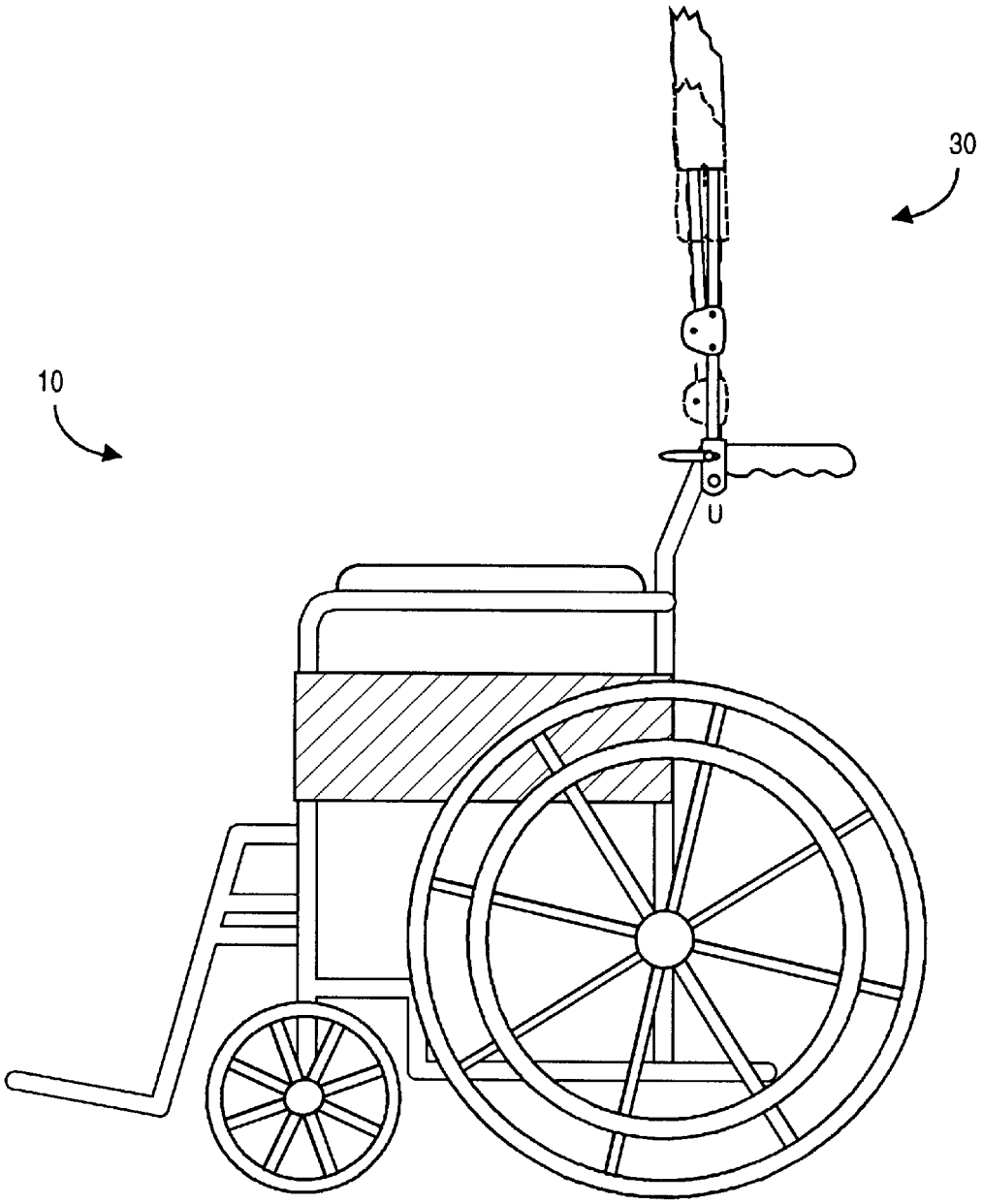
FIG. 1C is a side view of a wheelchair showing a collapsed, vertically upright oriented detachable adjustable weather shield, according to the present invention.
Figure 1D:
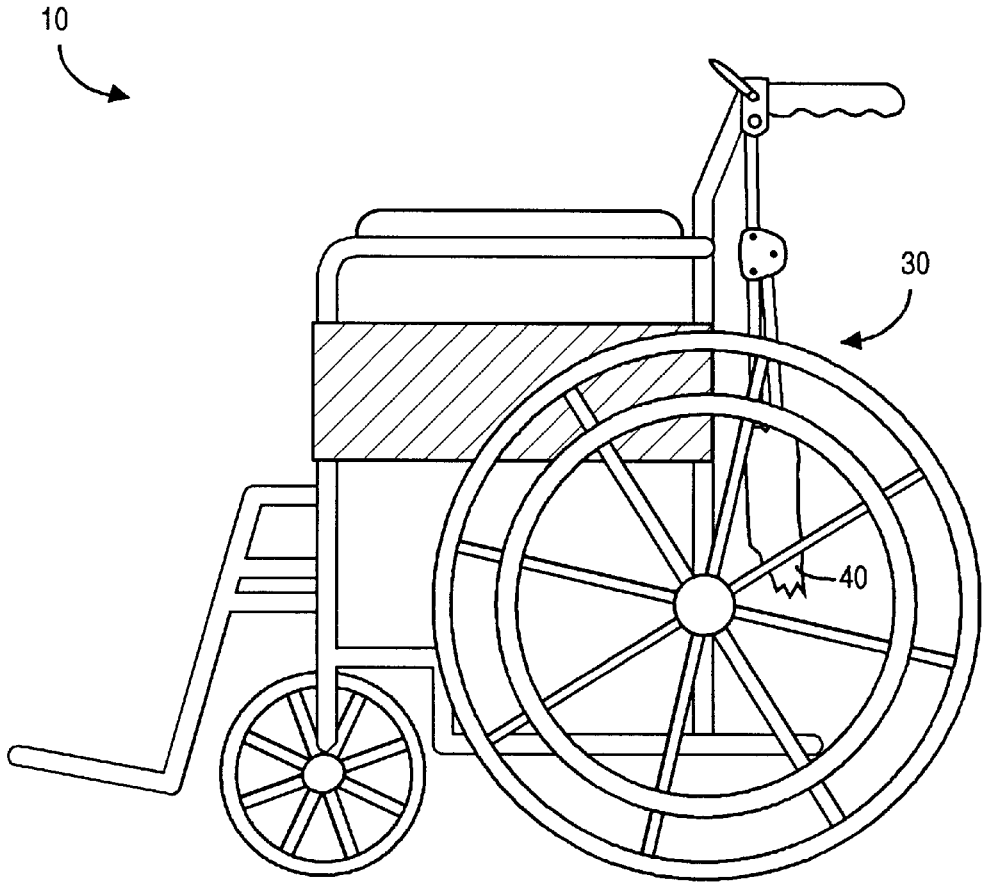
FIG. 1D is a side view of a wheelchair showing a collapsed and stowed detachable adjustable weather shield, according to the present invention.

It will be appreciated from FIGS. 1A and 1B that the user can bring about different weather shield orientations. For example, if the sun were directly overhead, or if it were raining essentially vertically, the orientation of FIG. 1A might be beneficial. However, if the sun or wind or rain were originating from behind the wheelchair, the orientations indicated by FIG. 1B would be more useful. This flexibility in orienting the weather shield is in contrast to what can readily be changed in prior art devices.

The embodiment of FIG. 1B recognizes that not all wheelchair users may have sufficient arm strength or mobility to manually adjust mechanism(s) 90 with levers 100 (or other mechanical devices). Accordingly, the embodiment of FIG. 1B provides a motor 110 whose power supply may be an on-wheel chair battery (shown in FIG. 1B as BATT), perhaps the battery that may be present to power a motorized wheelchair 10. It will be appreciated that the orientations shown in FIGS. 1A, 1C, 1D may also result from user adjustment made with a motor 110 to operate each anchor mechanism 90.

Motor 100 may be hardwired (wiring not shown) to a controller unit 120 conveniently disposed, perhaps near the arm rest portion of the wheel chair. Such controllers could be operated by moving a joystick, by pressing one or more buttons, by beaming light upon a sensor, even with user voice command, if desired. If desired, hardwiring could be eliminated by providing controller 120 with a short range transmitter 130, and by providing motor 110 with a receiver 140. Transmitter-receiver 130–140 may operate with radio frequencies, optical frequencies including infrared, and/or acoustic frequencies. Low sensitivity transmission-reception is preferred to avoid extraneous signals controlling motor 110, and thus from undesirably reorienting weather shield 30.

Figure 2A:
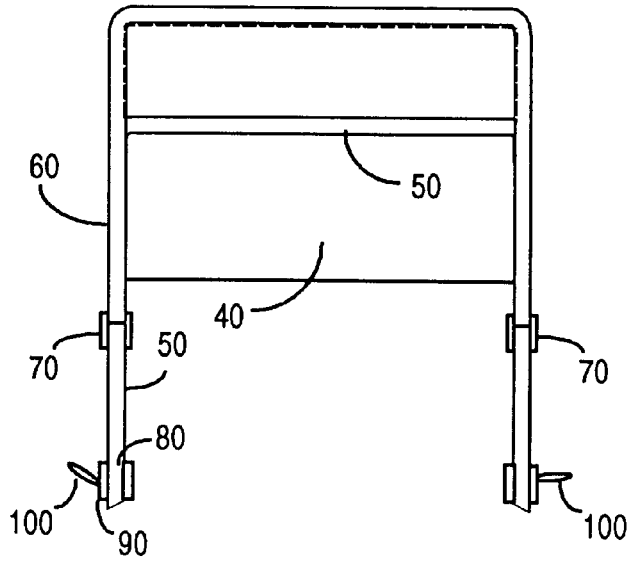
FIG. 2A is a view taken along line 2—2 in FIG. 1A of a canopy, with manually adjustable first and second frames, according to the present invention.
Figure 2B:
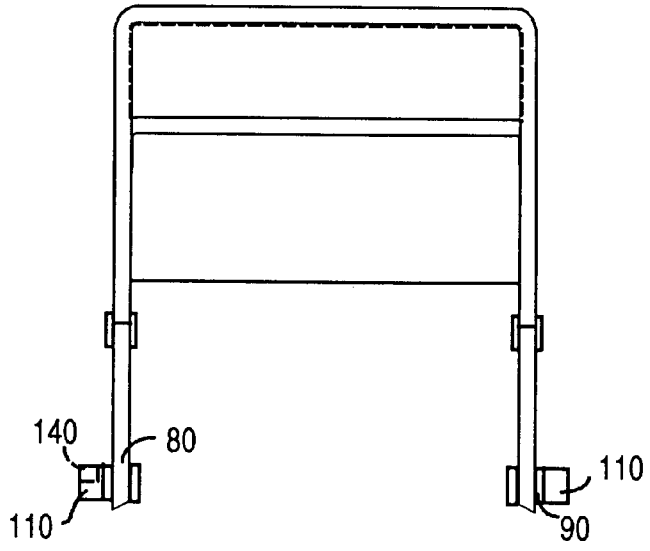
FIG. 2B is a view taken along line 2—2 in FIG. 1A of a canopy, with motorized adjustable first and second frames, according to the present invention.

FIGS. 2A and 2B depict views of canopy 40 and supporting frame members 50, 60 viewed along the section line 22 indicated in FIG. 1A. Note in the motorized embodiment of FIG. 2B, it is unnecessary that a receiver 140 be associated with each motor 110. Thus, if the right-side motor 110 is associated with a single receiver 140, control signals from receiver 140 can also command operation of the left-side motor as well.

FIG. 3A is an end view of an exemplary anchor unit 90 that is manually operated using lever 100. By contrast, the embodiment of FIG. 3B depicts a motorized anchor unit 90.

As shown in FIG. 3A, anchor unit 90 includes a two legged clampable member 200 that defines a through opening 210 sized to surround a portion of the push arm region 20 of wheelchair 10. Understandably, if a cross-section of the push arm region 20 is other than circular, then opening 210 will preferably be similarly shaped. A shaft 220 passes through both legs of member 200, and is secured at one end by a bolt or wingnut 230 and at the other end by a clamp unit 240.

Clamp unit 240 can act to compress the legs of member 200 such that opening 210 is reduced in cross-section to securely anchor mechanism 90 to the push arm region 30 of wheelchair 10. Thus, one function of clamp unit 240 is to controllable clamp and secure anchor mechanism 90 to wheelchair 10. Further, clamp unit 240 secures the distal end 80 of first frame member 50, to attach the present invention to anchor unit 90, and thus to wheelchair 10. More particularly, anchor unit 90 includes a frame rod retaining member 270 that includes a through opening 280 sized to admit the distal end 80 of first frame unit 50. Thus, a second function of clamp unit 240 is to controllably clamp the distal end of the first frame member to anchor unit 90 (and thus to the wheelchair), so as to permit user vertical adjustment relative to the height of the wheelchair push arm region.

Note in FIG. 3A that the outer leg portions of member 200 preferably include friction surfaces 250. These friction surfaces can frictionally engage facing friction surfaces 260 associated with distal portion 80 of first frame member 50, and with a facing portion of clamp unit 240.

Thus, if mechanism 240 is sufficiently loosened, angular rotation of weather shield 30 from anchor unit 90 may be accomplished. More specifically, in FIG. 3A if unit 240 is loosened, e.g., by rotation of lever 100, or by loosening nut 230, it becomes possible to rotate first frame 50 about the axis of shaft 220, to produce the angular rotation θ1 indicated in FIGS. 1B–1D. Thus, a third function of anchor unit 90 is to permit user adjustment of the angular orientation of the weather shield, e.g., to an angle θ1 most suitable to shield against incoming rain, sun, wind, etc. In a minimal compression or friction condition, unit 90 permits sliding distal end 80 of first member 50 up, down, or through opening 280 in member 260. Such vertical re-positioning is shown in phantom in FIG. 3A, and by the double vertical arrows at the bottom of the figure.

In the embodiment of FIG. 3B, controllably energizing motor 110 (e.g., under wired or wireless control from a controller/transmitter 120/130) can similarly vary compression exerted by member 200 upon the push arm region 30, and can vary friction between first frame member 50 and anchor unit 90. For example, motor rotation in one direction can reduce compression slightly, permitting the above noted angular orientation through various angles θ1. In a slightly reduced compression state the opposing frictional surfaces 250, 260 can rotate relative to one another, to define a user-selected angle θ1. Once a desired angle is attained, controller/transmitter 120/130 causes motor rotation in the opposite direction, whereupon anchor unit 90 re-compresses, the lock the present configuration. In the embodiment of FIG. 3A, rotating lever 100 (or equivalent) facilitates reduction and increase of compression to permit varying angular rotation θ1, as well as vertical adjustment of the weather shield.

It will be appreciated that motor 110 could also cause folding of canopy 40 as depicted in FIG. 1A. For example, as shown in FIG. 1B, a spring 300 or the like disposed between frame members 50 and 60 could normally bias the frame members apart, fully opening canopy 40 as shown in FIGS. 1A and 1B. Cables 310 from the left and right sides of frame members 60 could traverse left and right pulleys 320 mounted on frame member 50 such that the cables then travelled downward, parallel to frame member 50. A cog rotatable by motor 110 could then "wind in" the cables, essentially producing the decrease in angle Φ1 shown in FIG. 1A. When the motor 110 (or a clutch mechanism or the like) releases the wound in cable, the normal expansion bias from spring 300 would fully deploy canopy 40, as shown in FIG. 1B.

Modifications and variations may be made to the disclosed embodiments without departing from the subject and spirit of the invention as defined by the following claims.

What is claimed is:

1. An adjustable removable weather shield for use with a wheelchair having left and right push arm members, comprising:

a first generally inverted "U"-shaped frame member;

a first pivotable clamp unit secured to a first leg of said first frame member;

a second pivotable clamp unit secured to a second leg of said first frame member;

a second generally inverted "U"-shaped frame member, said second frame member having a first leg secured to said first pivotable clamp unit and having a second legal secured to said second pivotable clamp unit;

wherein the first and second pivotable clamp units permit user-controlled rotation between the first and second frame members;

a flexible canopy removably attached to a framework defined by an upper portion of said first and second frame members; and at least a first user releasable pivotable anchor unit adapted to be secured to a first of said push arm members;

said first anchor unit rotatably and releasably retaining a distal end portion of said first frame member.

2. The weather shield of claim 1, further including:

a second user releasable pivotable anchor unit adapted to be secured to a second of said push arm members;

said second anchor unit rotatably and releasably retaining a distal end portion of said second frame member.

3. The weather shield of claim 1, wherein:

said first anchor unit is manually operable.

4. The weather shield of claim 1, wherein:

said first anchor unit includes a motor and is motor operable.

5. The weather shield of claim 1, further including:

a bias member normally biased and disposed to urge said second frame member away from said first frame member so as to fully deploy said canopy.

6. The weather shield of claim 4, further including:

a user-operable control unit outputting at least one electrical signal commanding operation of said motor.

7. The weather shield of claim 5, further including:

said first anchor unit including a motor;

a user-operable control unit outputting at least one electrical signal commanding operation of said motor; and a mechanism coupling said bias member to said motor such that in response to said electrical signal, said motor exerts a counter-bias upon said bias member so as to urge said second frame member toward said first frame member so as to collapse said canopy.

8. The weather shield of claim 1 wherein said first pivotable anchor unit includes a quick release frictional mechanism.

9. The weather shield of claim 4, further including:

a control signal transmitter responsive to user commands to transmit at least one control signal;

a receiver, coupled to said motor, that receives said control signal and commands operation of said motor in response thereto.

10. The weather shield of claim 9, wherein said transmitter transmits said control signal using at least one energy form selected from a group consisting of (a) radio frequency energy, (b) infrared frequency energy, (c) optical frequency energy, and (d) acoustic frequency energy.

11. The weather shield of claim 1, wherein at least one of said first frame member and said second frame member is fabricated from a material selected from a group consisting of (a) aluminum, (b) plastic, and (c) epoxy.

12. The weather shield of claim 1, wherein at least one of said first frame member and said second frame member has a frame width approximating a width separating said left and right push arm members.

13. The weather shield of claim 1, wherein at least one of the first and said second pivotable clamp units includes detentes permitting fixed amounts of said user-controlled rotation.

14. The weather shield of claim 1, wherein said flexible canopy has at least one characteristic selected from a group consisting of (a) said canopy is made of plastic, (b) said canopy is made of water repellent cloth, (c) said canopy includes a transparent portion, (d) said canopy includes mechanisms for releasably attaching said canopy to said framework, and (e) said canopy includes snaps for releasably attaching said canopy to said framework.

15. An adjustable removable weather shield for use with a wheelchair having left and right push arm members, comprising:

a first generally inverted "U"-shaped frame member whose width approximates a width separating said left and right push arm members;

a first pivotable clamp unit secured to a first leg of said first frame member;

a second pivotable clamp unit secured to a second leg of said first frame member;

a second generally inverted "U"-shaped frame member whose width approximates said width of said first frame member, said second frame member having a first leg secured to said first pivotable clamp unit and having a second leg secured to said second pivotable clamp unit;

wherein the first and second pivotable clamp units permit user-controlled rotation between the first and second frame members;

a flexible canopy removably attached to a framework defined by an upper portion of said first and second frame members; and a first user releasable pivotable anchor unit adapted to be secured to a first of said push arm members and rotatably and releasably retaining a distal end portion of said first frame member; and a second user releasable pivotable anchor unit adapted to be secured to a second of said push arm members and rotatably and releasably retaining a distal end portion of said second frame member.

16. The weather shield of claim 15, wherein:

said first anchor unit has at least one characteristic selected from a group consisting of (a) said unit is manually operable, (b) said unit includes a motor and is motor operable.

17. The weather shield of claim 15, further including:

a bias member normally biased and disposed to urge said second frame member away from said first frame member so as to fully deploy said canopy.

18. A method for providing a wheelchair with an adjustable removable weather shield, the method comprising the following steps:

(a) providing a framework for collapsibly and rotatably securing a canopy over at least a portion of said wheelchair;

(b) attaching a canopy to said framework;

(c) rotatably and releasably securing distal end portions of said framework to said wheelchair; and (d) providing a mechanism enabling a user of said wheelchair to control rotation and orientation of said canopy relative to said wheelchair as well as to control relative vertical adjustment of said canopy relative to said portion of said wheelchair as well as to remove said framework from said wheelchair.

19. The method of claim 18, wherein:

step (c) includes coupling first and second quick release friction anchor units to left and right push arm portions of said wheelchair; and step (d) includes providing said user with a manual control directly controlling friction exerted by said anchor units.

20. The method of claim 18, wherein:

step (c) includes coupling first and second quick release friction anchor units to left and right push arm portions of said wheelchair; and step (d) includes providing said user with a motor that directly controls friction exerted by said anchor units.

* * * * *